US010704305B2

(12) United States Patent
Miyachi

(10) Patent No.: US 10,704,305 B2
(45) Date of Patent: Jul. 7, 2020

(54) DOOR OPENING/CLOSING DEVICE

(71) Applicant: RISO KAGAKU CORPORATION, Tokyo (JP)

(72) Inventor: Ryosuke Miyachi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 330 days.

(21) Appl. No.: 15/001,663

(22) Filed: Jan. 20, 2016

(65) Prior Publication Data

US 2016/0215539 A1 Jul. 28, 2016

(30) Foreign Application Priority Data

Jan. 22, 2015 (JP) ..... 2015-010178

(51) Int. Cl.
*E05C 19/12* (2006.01)
*E05C 5/00* (2006.01)
(Continued)

(52) U.S. Cl.
CPC ..... *E05C 19/12* (2013.01); *E05B 47/0001* (2013.01); *E05B 47/0004* (2013.01);
(Continued)

(58) Field of Classification Search
CPC ..... E05B 15/0093; E05B 47/0001; E05B 47/0004; E05B 65/006; E05B 65/02; E05B 57/00; E05B 2063/0026; E05B 2047/0073; E05B 2047/2047; E05B 2047/0074; E05B 2047/0094; E05B 47/023; E05B 47/026; E05B 47/0603; E05B 47/0607;
(Continued)

(56) References Cited

U.S. PATENT DOCUMENTS 709,607 A * 9/1902 Podlesak ..... E06B 7/084 292/201
971,423 A * 9/1910 Walters ..... E05B 81/20 292/201
(Continued)

FOREIGN PATENT DOCUMENTS

DE 19800713 7/1999
DE 102015201106 A1 * 7/2016 ..... E05B 47/023
(Continued)

*Primary Examiner* — Christine M Mills
(74) *Attorney, Agent, or Firm* — Hamre, Schumann, Mueller & Larson, P.C.

(57) ABSTRACT

A door opening/closing device including a door, a locking hook mounted on an inner surface of the door, a solenoid mounted in a device housing, a locking lever connected swingably to a movable iron core of the solenoid and having a free end on an opposite side of a connection portion, and a controller for controlling the solenoid, in which the controller executes control so as to, if the door is closed and locked, separate the locking lever from the locking hook to release locking in conjunction with the movable iron core retreated by an electromagnetic attracting force by executing conduction control of the solenoid, and maintain an unlocked state while the door is closed by executing non-conduction control of the solenoid after unlocking and bringing the free end of the locking lever into contact with the locking hook by a return spring force.

9 Claims, 7 Drawing Sheets

(51) Int. Cl.
*E05B 47/00* (2006.01)
*E05B 47/02* (2006.01)
*E05C 5/04* (2006.01)

(52) U.S. Cl.
CPC ..... *E05B 47/026* (2013.01); *E05C 5/00* (2013.01); *E05C 5/04* (2013.01); *E05B 2047/0073* (2013.01); *E05C 2005/005* (2013.01)

(58) Field of Classification Search
CPC ..... E05B 2047/0075; E05B 2047/0078; E05B 65/5292; E05C 1/08; E05C 3/12; E05C 3/38; E05C 3/40; E05C 2005/005; E05C 5/02; E05C 5/04; E05C 5/00; E05C 19/10; E05C 19/12; Y10T 292/0948; Y10T 292/0949; Y10T 292/1043; Y10T 292/1051; Y10T 292/1052; Y10T 292/1055; Y10T 292/1059; Y10T 292/108; Y10T 292/1082; Y10T 292/0831; Y10T 292/081; Y10T 292/0826; Y10T 292/0828; Y10T 292/0862; Y10T 292/0911; Y10T 292/0946; Y10T 292/0937; Y10T 292/1006; Y10T 292/1063; Y10S 292/26
USPC ..... 292/29, 11, 25, 26, 56, 95, 97, 99, 100, 292/194, 219, 220, 223, 226, 200, 201, 292/DIG. 26, 130, 183, 230
See application file for complete search history.

(56) References Cited

U.S. PATENT DOCUMENTS 1,057,608 A * 4/1913 Wurmb et al. ..... E05B 81/20 292/201
1,312,895 A * 8/1919 Derby ..... E05B 81/20 292/201
2,321,591 A * 6/1943 Gardner ..... E05F 15/665 292/201
2,800,348 A * 7/1957 Parsley ..... E05B 47/0002 292/201
3,113,352 A * 12/1963 Gibbs ..... E05B 51/02 292/201
3,386,761 A * 6/1968 Johnstone ..... E05B 77/48 292/201
3,733,456 A * 5/1973 Blackburn ..... H05B 6/6417 219/719
3,915,491 A * 10/1975 Montgomery ..... B60K 15/05 296/97.22
3,955,840 A * 5/1976 Rawls ..... E05B 47/0002 292/201
4,088,354 A * 5/1978 Kolendowicz ..... E05B 47/0603 292/201
4,101,745 A * 7/1978 Smith ..... E05B 47/0002 200/61.61
4,170,374 A * 10/1979 Garcia ..... E05B 47/0012 292/201
4,268,076 A * 5/1981 Itoi ..... E05B 65/461 292/201
4,393,970 A * 7/1983 Strack, Jr. ..... G07F 11/62 194/205
4,424,426 A * 1/1984 Ishii ..... E05B 47/0002 200/61.61
4,470,625 A * 9/1984 Walsh ..... E05B 65/1066 292/201
4,603,239 A * 7/1986 Ishii ..... E05B 17/22 200/61.61
4,659,884 A * 4/1987 Wollenhaupt ..... E05B 47/0002 200/50.01
4,720,611 A * 1/1988 Ishii ..... E05B 47/0002 200/61.61
4,720,675 A * 1/1988 Bishop ..... G01R 1/04 292/144
5,004,276 A * 4/1991 Hanley ..... E05C 19/022 292/126
5,072,974 A * 12/1991 Henne ..... E05C 19/022 292/126
5,078,382 A * 1/1992 Tanjo ..... B65H 1/04 221/153
RE34,396 E * 10/1993 Wollenhaupt ..... E05B 47/0002 192/135
5,492,382 A * 2/1996 McBride ..... E05B 47/0002 292/201
5,690,373 A * 11/1997 Luker ..... E05B 47/0607 292/144
5,755,126 A * 5/1998 Lanigan ..... E05B 47/0002 292/201
5,806,355 A * 9/1998 Lanigan ..... E05B 47/0002 248/282.1
5,918,704 A * 7/1999 Chevilliard ..... B66B 13/165 187/335
6,192,723 B1 * 2/2001 Brownell, Sr. ..... E05B 47/0002 292/144
6,731,212 B2 * 5/2004 Hirose ..... E05B 45/005 340/572.1
7,293,805 B1 * 11/2007 Hsieh ..... E06B 9/82 160/9
7,603,882 B2 * 10/2009 Carbajal ..... A47F 3/043 292/201
8,047,582 B1 * 11/2011 Rodgers ..... E05B 15/022 292/201
8,665,119 B2 * 3/2014 Hashberger ..... B64D 11/003 244/117 R
8,757,677 B2 * 6/2014 Wintersteiger ..... E05B 47/0696 292/201
8,789,859 B2 * 7/2014 Curtis ..... E05B 15/0295 292/201
9,777,512 B2 * 10/2017 Curtis ..... E05B 65/0021
9,777,514 B2 * 10/2017 Haidvogl ..... E05B 47/0607

FOREIGN PATENT DOCUMENTS

FR 2749343 12/1997
JP S50-004991 1/1975
JP S54-094292 7/1979
JP S60-138179 7/1985
JP H05-14443 2/1993
JP 2007052635 A * 3/2007
JP 2010-242448 10/2010
JP 2014-085878 5/2014
JP 2014085878 A * 5/2014

* cited by examiner

DOOR OPENING/CLOSING DEVICE

BACKGROUND

1. Technical Field

The present invention relates to a door opening/closing device for locking and unlocking of a door by using a locking hook mounted on an inner surface of the door and a locking lever swingably connected to a movable iron core side of a solenoid mounted in a device housing when the door is mounted on the device housing of an electronic device and the like so as to be opened and closed.

2. Related Art

In general, the door opening/closing device is employed for various electronic devices including a printer, a copier and the like. Particularly, in order to ensure safety to the electronic devices and safety for humans, the door opening/closing device is configured to lock and close the door mounted on the device housing so as to be opened and closed, release locking to the door when a user or service man needs to open the door, and maintain the locking to the door when the user or service man does not have to open the door.

As an example of this type of the door opening/closing device, an opening/closing mechanism using a solenoid is known (see Japanese Patent Application Laid-Open Publication No. 2014-85878, for example as Patent Literature 1).

In the opening/closing mechanism disclosed in Patent Literature 1, on an insertion port of a front case provided in an information writing device, a cover is provided rotatably in a vertical direction so as to cover the insertion port and also, the cover is urged to an open position by an action of a torsion spring.

Moreover, a locking hook is integrally mounted on an inner surface of the cover.

Moreover, on an inner surface side of the cover, a solenoid is provided along a vertical direction. A coil spring is fitted in a plunger (movable iron core) of this solenoid, and a lock lever is connected to a tip end portion of the plunger in front of this coil spring along a horizontal direction substantially orthogonal to this plunger.

The aforementioned lock lever has its intermediate portion in a longitudinal direction pivotally supported swingably by a projecting shaft, and the plunger of the solenoid is connected through a pin to one end portion side of the lock lever through the projecting shaft. Moreover, a locking claw formed on the other end portion side of the lock lever through the projecting shaft is capable of being engaged with the locking hook provided on the inner surface of the cover.

Then, when the cover is at a closed position, the locking hook provided on the inner surface of the cover and the locking claw of the lock lever are engaged with each other to lock the cover. At this time, a self-weight of the plunger of the solenoid and an urging force of the coil spring maintain a locked state to the cover.

On the other hand, when the cover is to be opened, by electrifying the solenoid, the plunger of the solenoid is electromagnetically attracted against the urging force of the coil spring. Thus, the locking claw of the lock lever is separated away from the locking hook provided on the inner surface of the cover, and the cover is configured to be automatically opened by the urging force of the torsion spring.

SUMMARY

Incidentally, in the door opening/closing device described in the aforementioned Patent Literature 1, the insertion port of the front case is covered by the locked cover during use of the information writing device, which ensures safety.

On the other hand, by electrifying the solenoid from the state in which the cover is locked, the cover can be unlocked, but processing to the solenoid after the cover is unlocked is not disclosed. At this time, if conduction to the solenoid continues after the cover is unlocked, a temperature of the solenoid is raised, which gives a bad influence to members in the periphery.

Thus, an object of the present invention is to provide a door opening/closing device, which, when a door is mounted on a device housing of an electronic device and the like so as to be opened and closed, can suppress a temperature rise of the solenoid that locks and unlocks the door, can promote power saving, and allow a user or a service man to open the door at intended timing.

The present invention has been made in view of the above problem and a first feature of the present invention is that a door opening/closing device includes:

a door mounted on a device housing so as to be opened and closed;

a locking hook mounted on an inner surface of the door;

a solenoid mounted in the device housing and having a movable iron core advancing/retreating between a first position advanced by a return spring force during non-conduction and a second position retreated by an electromagnetic attracting force against the return spring force during conduction;

a locking lever connected swingably on a movable iron core side of the solenoid and having a free end on an opposite side of a connection portion; and a controller for controlling the solenoid, wherein the controller executes control so as to when the door is closed, maintain a locked state of the door by locking the locking lever to the locking hook in conjunction with the movable iron core advanced to the first position by executing non-conduction control of the solenoid; and if a need to open the door arises while the door is in the locked state, separate the locking lever from the locking hook to release locking in conjunction with the movable iron core retreated to the second position by executing conduction control of the solenoid, bring the free end of the locking lever into contact with the locking hook by the return spring force in conjunction with the movable iron core advanced to the side of the first position by executing non-conduction control of the solenoid after unlocking, and maintain an unlocked state of the door while the door is closed.

Moreover, a second feature of the present invention is that, in the door opening/closing device having the aforementioned first feature, the locking hook is formed by extending to an inner side of the device housing from the inner surface of the door and includes a locking claw portion at its tip end;

if the door is opened when the door reaches the unlock maintained state while the solenoid is in a non-conduction state by the controller, the locking lever is separated from a side surface of the locking hook moving integrally with the door so that the movable iron core advances to the first position by the return spring force; and if the door is closed after the movable iron core advances to the first position, the locking lever advanced by the movable iron core is lifted by an inclined surface formed on a back surface of the locking claw portion of the locking hook along with a closing operation of the door, and is locked to the locking claw portion after the locking claw portion is overridden.

Moreover, a third feature of the present invention is that, in the door opening/closing device having the aforementioned first feature or the second feature, the locking lever is swingably connected to a side of the other end portion of a lever in which the movable iron core of the solenoid is connected to an intermediate portion between one end portion and the other end portion and the one end portion is pivotally supported swingably.

BRIEF DESCRIPTION OF DRAWINGS

The invention will now be described with reference to the accompanying drawings wherein.

DETAILED DESCRIPTION

Embodiments of a door opening/closing device according to the present invention will be described below with reference to FIGS. 1 to 11 in detail in order of a first embodiment and a second embodiment.

The door opening/closing device according to the present invention is applied to electronic devices such as an image forming apparatus for printing images and characters on a sheet, a copier for copying images and characters on the sheet, and a sheet processing device for executing various types of processing to the sheet.

The door opening/closing device according to the present invention locks a door by a locking hook mounted on an inner surface of the door and a locking lever connected siwngably to a movable iron core side of a solenoid provided in a device housing when the door is mounted on the device housing so as to be opened and closed. Then, the door opening/closing device according to the present invention is configured such that conduction control of the solenoid is temporarily executed so as to unlock the door when a need to open the locked door arises and to execute non-conduction control of the solenoid after unlocking so as to maintain an unlocked state while the door is closed.

First, an image forming apparatus which is an example of the electronic device to which the door opening/closing device according to the present invention is applied will be described by using FIG. 1.

(Image Forming Apparatus)

Figure 1:
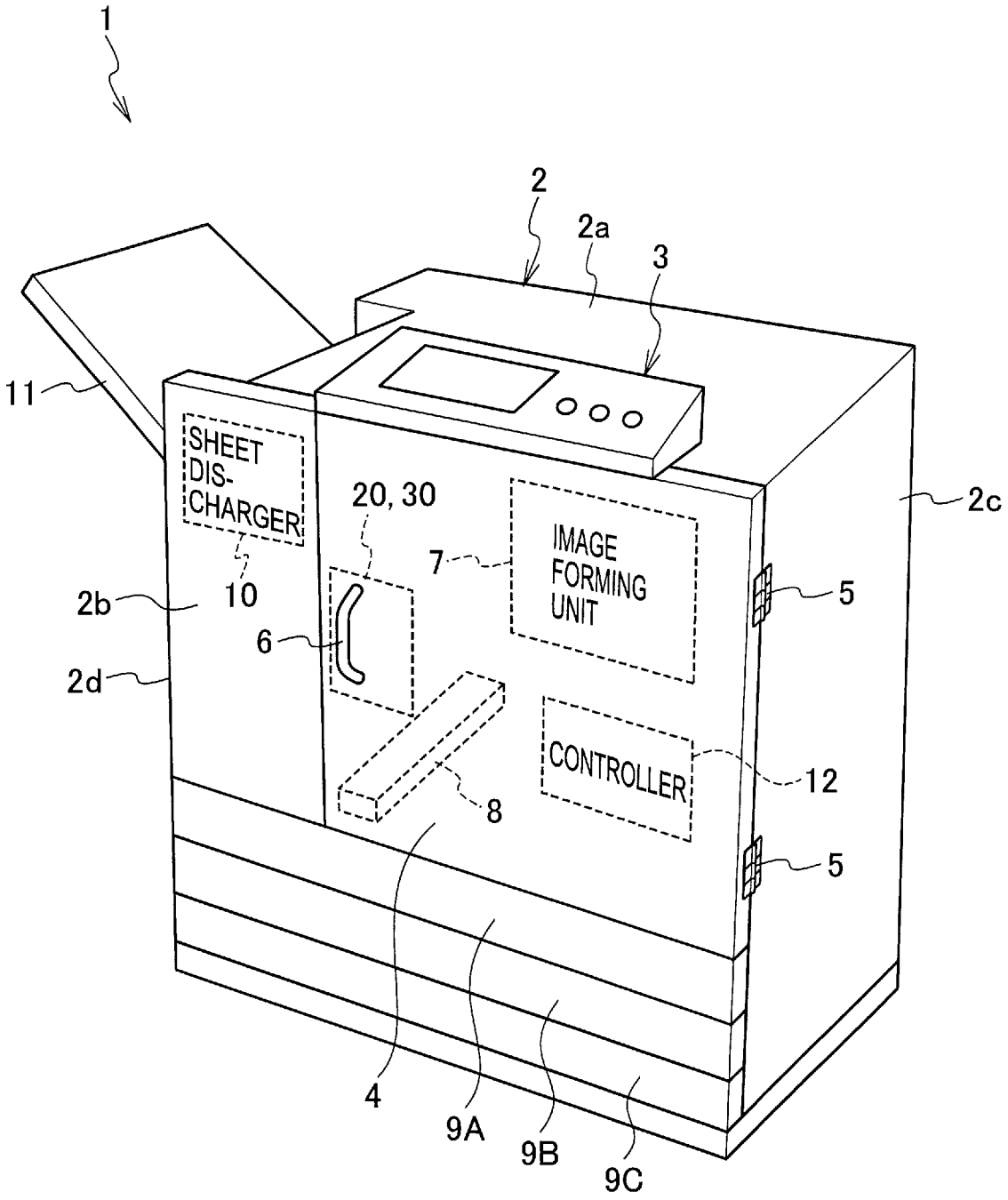
FIG. 1 is a perspective view illustrating an appearance of an image forming apparatus to which a door opening/closing device according to the present invention is applied.

FIG. 1 perspectively illustrates an appearance of an image forming apparatus to which the door opening/closing device according to the present invention is applied.

As illustrated in FIG. 1, in the image forming apparatus 1 to which the door opening/closing device according to the present invention is applied, a device housing 2 is formed having a substantial box shape.

On a top surface 2*a* of this device housing 2, an operation panel portion 3 for operating this image forming apparatus 1 is mounted.

Moreover, on the right on a front surface 2*b* side of the device hosing 2, a door 4 is mounted so as to be opened and closed by hinges 5 and 5 disposed on upper and lower parts on the front of a right side surface 2*c* of the device housing 2. On an outer side of this door 4, a handle 6 is integrally mounted.

Moreover, on an inner side of the door 4 close to the handle 6, a door opening/closing device 20 according to the first embodiment of the present invention or a door opening/closing device 30 according to a second embodiment of the present invention is provided.

Moreover, on an upper part on the inner side of the door 4, an image forming unit 7 for forming an image on a sheet, not shown, is provided, and on a lower part on the inner side of the door 4, a sheet feeding portion 8 for feeding a sheet, not shown, toward the image forming unit 7 is provided.

Moreover, on a lower part of the door 4, a plurality of sheet feed trays 9A, 9B and 9C in which the sheets, not shown, are stacked according to the sheet size is stacked in three stages and provided capable of being withdrawn toward the front surface 2*b* side of the device housing 2.

Moreover, on an inner upper part on a left side surface 2*d* side of the device housing 2, a sheet discharger 10 for discharging the sheet with an image formed, not shown, fed from the image forming unit 7 is provided, and the sheet with an image formed discharged by this sheet discharger 10 is stacked on a sheet discharge tray 11 formed by projecting toward an outer side of the device housing 2.

Furthermore, a controller 12 for entirely controlling the image forming apparatus 1 is installed at an appropriate spot in the device housing 2.

(Door Opening/Closing Device of First Embodiment)

Here, the door opening/closing device according to the first embodiment of the present invention will be described by using FIGS. 2 to 6.

Figure 2:
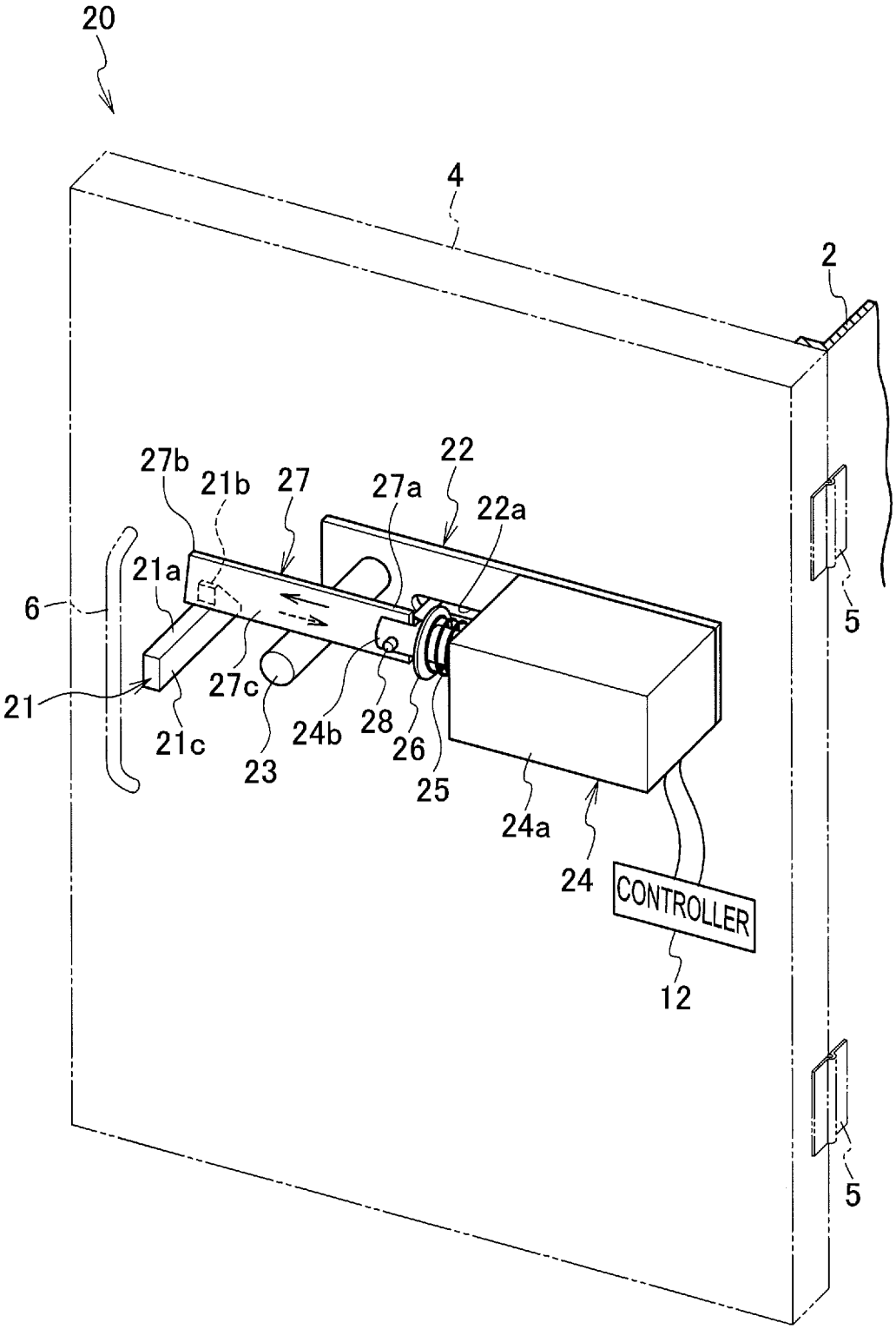
FIG. 2 is a perspective view illustrating constitution of the door opening/closing device according to a first embodiment of the present invention and is a perspective view illustrating a first operation state in which a door is locked and closed.

FIG. 2 is a view illustrating constitution of the door opening/closing device according to the first embodiment of the present invention and schematically illustrates a first operation state in which the door is locked and closed. Moreover, FIGS. 3 to 6 schematically illustrate a second operation state to a fifth operation state in which locking to a door is released to open the door and then the door is closed again in the door opening/closing device according to the first embodiment of the present invention in an order of the operations. In FIGS. 3 to 6, the door is not shown.

As illustrated in FIG. 2, in the door opening/closing device 20 according to the first embodiment of the present invention, the door 4 is provided so as to be opened and closed to the device housing 2 of the image forming apparatus 1 (FIG. 1) through the hinges 5 and 5.

Moreover, on the inner surface of this door 4 close to the handle 6 mounted on the outer side of the door 4, a locking hook 21 is integrally mounted. This locking hook 21 is formed by extending from the inner surface of the door 4 into the device housing 2 and includes a locking claw portion 21*b* described below at the tip end thereof.

That is, in the aforementioned locking hook 21, a locking base portion 21*a* having a rectangular shape substantially at a right angle to the inner surface of the door 4 and protruding substantially horizontally toward a depth in the device housing 2, the locking claw portion 21*b* protruding upward having a substantially triangular shape from a tip end portion on the depth of the locking base portion 21*a* which is a tip end on the opposite side of the inner surface of the door 4, and a side surface 21*c* of the locking base portion 21*a* going to the depth with a predetermined height are integrally formed.

Moreover, on a bracket 22 which is a fixed member mounted substantially in parallel with the door 4 on the depth in the device housing 2, a cylindrical guide member 23 is mounted on the locking hook 21 side substantially in parallel with the locking hook 21 toward the inner surface of the door 4.

At this time, the cylindrical guide member 23 includes a function of temporarily guiding a lower surface of a locking lever 27, which will be described later, in a height direction, and a portion in contact with the lower surface of the locking lever 27 in this guide member 23 is disposed at a position lower than the locking base portion 21*a* of the locking hook 21.

Moreover, on the bracket 22, a solenoid 24 is mounted at an interval on the right from the locking hook 21, and this solenoid 24 faces the inner surface of the door 4 and is fixed in a substantially horizontal attitude with its longitudinal direction in the right and left.

The aforementioned solenoid 24 accommodates an annular bobbin (not shown) around which a coil (not shown) is wound in a cuboid yoke 24*a*, and a lengthy movable iron core 24*b* formed having a cylindrical shape is accommodated in the bobbin linearly movably in the right-and-left direction (arrow direction) capable of advancing/retreating.

At this time, the movable iron core 24*b* of the solenoid 24 is configured to linearly move between a first position advancing to the left side by a return spring force which will be described later in non-conduction and a second position retreating to the right side by an electromagnetic attracting force against a return spring force in non-conduction by ON/OFF control of an electric current to the coil through the controller 12 provided in the image forming apparatus 1 (FIG. 1).

That is, the movable iron core 24*b* of the solenoid 24 goes closer to the locking hook 21 by the return spring force in non-conduction and separates away from the locking hook 21 by the electromagnetic attracting force against the return spring force in conduction.

Moreover, on a tip end side of the movable iron core 24*b* of the solenoid 24, after a compression spring 25 for return urging this movable iron core 24*b* to a side of the first position and a ring-shaped washer 26 are fitted in, a plate-shaped locking lever 27 is swingably connected by a connecting pin 28 toward the locking hook 21 side.

The aforementioned locking lever 27 has a side surface 27*c* formed having a rectangular plate shape between one end portion 27*a* on the right and the other end portion 27*b* on the left, and an intermediate portion of this locking lever 27 in the longitudinal direction crosses from above and across the guide member 23 mounted on the bracket 22.

The one end portion 27*a* side of the locking lever 27 is connected to the movable iron core 24*b* of the solenoid 24 through the connecting pin 28. Moreover, the other end portion 27*b* side of the locking lever 27 is located on an opposite side of the connection portion connected to the movable iron core 24*b* through the connecting pin 28 and has a free end on a tip end portion and is swingable in the vertical direction around the connecting pin 28. As the movable iron core 24*b* of the solenoid 24 linearly moves between the first position and the second position, the other end portion 27*b* side is capable of getting close to/separating away from the locking base portion 21*a* and the locking claw portion 21*b* of the locking hook 21 mounted on the inner surface of the door 4.

At this time, since the locking lever 27 is directly connected to the movable iron core 24*b* of the solenoid 24, though a connection structure is simple, a moving amount of the locking lever 27 in the right-and-left direction is the same as a stroke of the movable iron core 24*b* linearly moving between the first position and the second position, and thus, respective widths of the locking base portion 21*a* and the locking claw portion 21*b* of the locking lever 27 are set in correspondence with this stroke.

The connecting pin 28 connecting the one end portion 27*a* of the locking lever 27 to the movable iron core 24*b* of the solenoid 24 protrudes lengthily toward the bracket 22 side, and this connecting pin 28 is fitted in a long hole 22*a* formed in the bracket 22 in parallel with the movable iron core 24*b*. Thus, the movable iron core 24*b* can move linearly without rotating, and the movable iron core 24*b* that reached the first position by the return spring force is regulated not to remove from inside the solenoid 24 by the connecting pin 28 fitted in the aforementioned long hole 22*a*.

When the door opening/closing device 20 according to the first embodiment of the present invention is configured as described above, FIG. 2 shows a first operation state in which the door 4 is locked and closed in a perspective manner.

In this first operation state, since the solenoid 24 is subjected to non-conduction control by the controller 12 when the door 4 is closed, the movable iron core 24*b* of the solenoid 24 reaches the first position advanced to the left by the return spring force of the compression spring 25 for return.

At this time, the other end portion 27*b* side of the locking lever 27 connected to the movable iron core 24*b* of the solenoid 24 is mounted closer to the inner surface side of the door 4 than the locking claw portion 21*b* on the locking base portion 21*a* of the locking hook 21 mounted on the inner surface of the door 4 by the own weight of the locking lever.

As a result, when a user or service man grasps the handle 6 and tries to open the door 4 toward the front, the side surface 27*c* on the other end portion 27*b* side of the locking lever 27 mounted on the locking base portion 21*a* of the locking hook 21 is brought into contact with the locking claw portion 21*b* of the locking hook 21 and locked. Thus, the door 4 cannot be opened.

Therefore, in the first embodiment, the side surface 27*c* on the other end portion 27*b* side of the locking lever 27 functions as a locking portion, while the locking claw portion 21*b* of the locking hook 21 functions as a locked portion to be locked to the locking portion of the locking lever 27.

Figure 3:
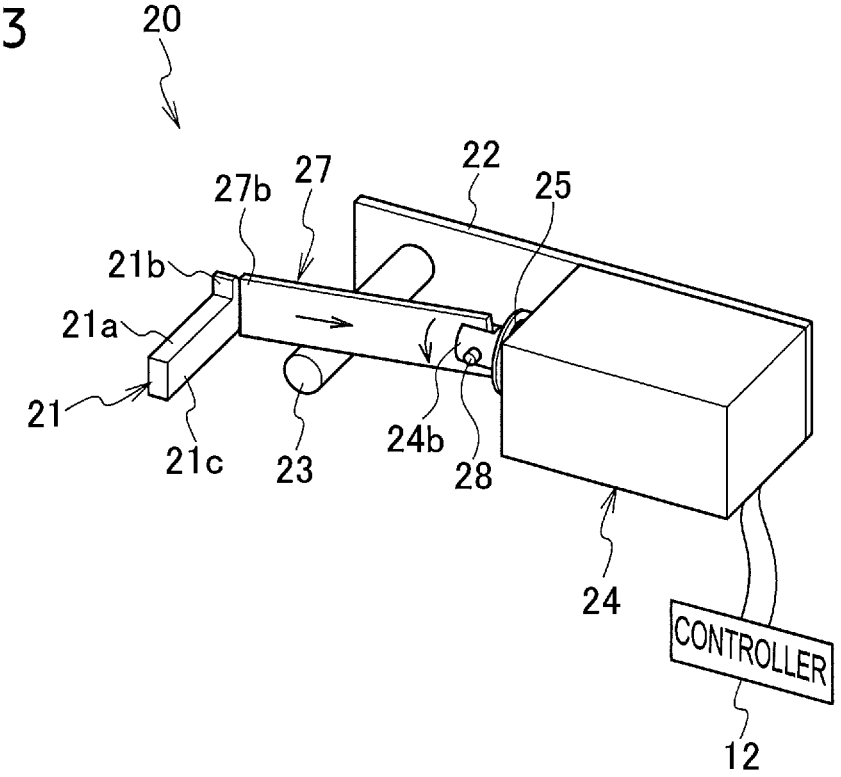
FIG. 3 is a perspective view illustrating a second operation state in which a solenoid is temporarily subjected to conduction control so as to unlock the door in the door opening/closing device according to the first embodiment of the present invention.

Subsequently, FIG. 3 illustrates a second operation state in which the door 4 is unlocked by subjecting the solenoid 24 to temporary conduction control in a perspective manner.

In this second operation state, when the door 4 is closed and locked, if the user or service man pushes a door-open button (not shown) mounted on the operation panel portion 3 of the image forming apparatus 1 (FIG. 1) or sheet jamming that occurred in the image forming apparatus 1 is automatically detected, the controller 12 subjects the solenoid 24 to temporary conduction control. At this time, the controller 12 executes control such that those other than the solenoid 24 in the image forming apparatus 1 (FIG. 1) stop operations.

At this time, if the state in which the solenoid 24 is conducted continues, the solenoid 24 generates heat and badly affects the peripheral members or the electromagnetic attracting force of the movable iron core 24*b* weakens and thus, in this first embodiment, conduction to the solenoid 24 is performed temporarily only for a short time.

By means of this conduction control to the solenoid 24, the movable iron core 24*b* of the solenoid 24 retreats to the right side by the electromagnetic attracting force against the return spring force of the compression spring 25 for return and reaches the second position.

Along with that, since the locking lever 27 connected to the movable iron core 24*b* of the solenoid 24 through the connecting pin 28 moves to the right side, the other end portion 27*b* side of this locking lever 27 separates away from the locking base portion 21*a* and the locking claw portion 21*b* of the locking hook 21 mounted on the inner surface of the door 4.

As a result, a slight gap is formed between the side surface 21*c* of the locking hook 21 and the tip end portion of the other end portion 27*b* of the locking lever 27, and the door 4 is unlocked.

Then, since the locking lever 27 swings downward by its own weight around the connecting pin 28, the other end portion 27*b* side of the locking lever 27 drops, and the intermediate portion in the longitudinal direction is brought into contact with the upper part of the guide member 23 disposed on the bracket 22 at a position lower than the locking base portion 21*a* of the locking hook 21.

If the power supply, not shown, in the image forming apparatus 1 (FIG. 1) fails, temporary conduction to the solenoid 24 becomes impossible, and in this case, the service man can unlock the door 4 by lifting up the other end portion 27*b* side of the locking lever 27 upward around the connecting pin 28 by using a thin wire or the like through a gap of the closed door 4.

Figure 4:
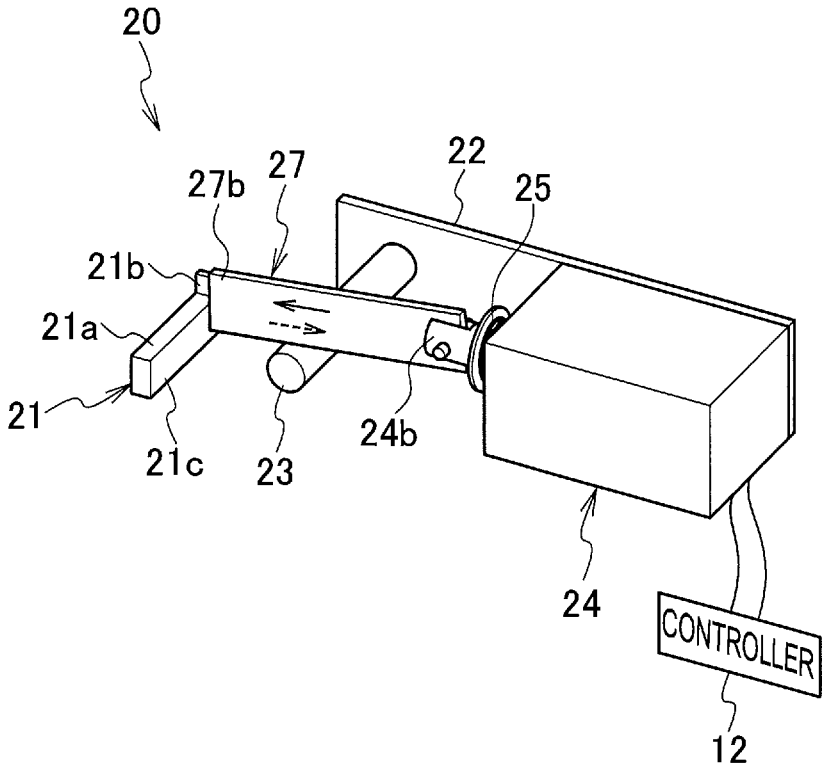
FIG. 4 is a perspective view illustrating a third operation state in which temporary conduction to the solenoid is stopped in a state in which the door is unlocked in the door opening/closing device according to the first embodiment of the present invention.

Subsequently, FIG. 4 illustrates a third operation state in a perspective manner in which temporary conduction to the solenoid 24 is stopped in a state in which the door 4 is unlocked.

In this third operation state, when the door 4 is unlocked, the controller 12 stops the temporary conduction to the solenoid 24 and executes non-conduction control at appropriate timing after unlocking.

By means of this stop of the temporary conduction to the solenoid 24, the movable iron core 24*b* of the solenoid 24 tries to advance to the left side by the return spring force of the compression spring 25 for return. At this time, the tip end portion (free end) of the other end portion 27*b* of the locking lever 27 connected to the movable iron core 24*b* of the solenoid 24 is brought into contact with the side surface 21*c* of the locking hook 21 mounted on the inner surface of the door 4 by the return spring force.

Therefore, in the first embodiment, the tip end portion of the other end portion 27*b* of the locking lever 27 functions as a touching portion, while the side surface 21*c* of the locking hook 21 functions as a touched portion to be touched by the touching portion of the locking lever 27.

Along with that, since the locking lever 27 is pushed back to the right side by the side surface 21*c* of the locking hook 21 while being guided by the guide member 23 mounted on the bracket 22, the movable iron core 24*b* of the solenoid 24 is also pushed back to the right side integrally with this locking lever 27 and thus, the state in which the door 4 is unlocked is maintained.

As a result, when the door 4 is unlocked, since the solenoid 24 is in the non-conduction state, a temperature rise of the solenoid 24 can be suppressed and at the same time, power for the door opening/closing device 20 can be saved.

Figure 5:
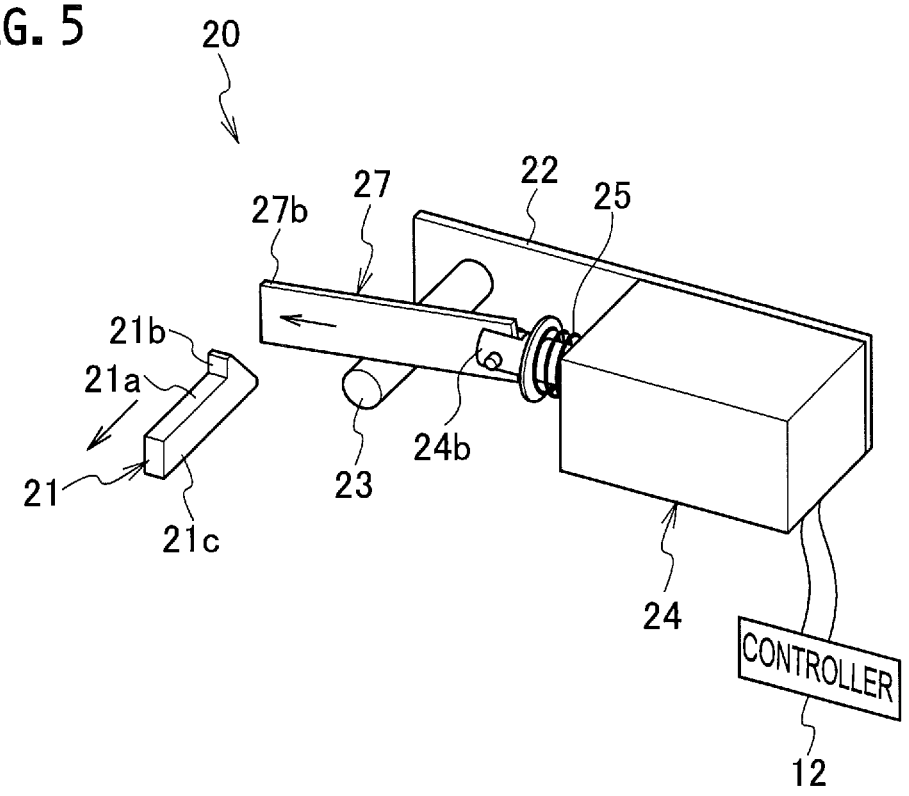
FIG. 5 is a perspective view illustrating a fourth operation state in which the door is unlocked and the door is opened in a state in which the solenoid is subjected to non-conduction control in the door opening/closing device according to the first embodiment of the present invention.

Subsequently, FIG. 5 illustrates a fourth operation state in a perspective manner in which the door 4 is unlocked and the door 4 is opened while the solenoid 24 is subjected to non-conduction control.

In this fourth operation state, the door 4 is unlocked by the controller 12 while the solenoid 24 is in the non-conduction state, and the door 4 reaches the unlock maintained state and thus, the user or service man can open the door 4 at intended timing.

Then, when the user or service man opens the door 4, the locking hook 21 also moves to an opening direction of the door 4 integrally with the door 4. Then, the tip end portion of the other end portion 27*b* of the locking lever 27 is separated away from the side surface 21*c* of the locking hook 21 during movement in the opening direction integrally with the door 4.

As a result, the urging force of the compression spring 25 for return having been suppressed by the contact of the tip end portion of the other end portion 27*b* of the locking lever 27 with the side surface 21*c* of the locking hook 21 is released.

Along with that, since the locking lever 27 is made movable to the left side by being guided by the guide member 23 mounted on the bracket 22, the movable iron core 24*b* of the solenoid 24 returns to the first position advanced to the left side by the return spring force of the compression spring 25 for return integrally with the locking lever 27.

Here, when the door 4 is opened, the user can securely remove the jamming sheet (not shown) occurring in the image forming apparatus 1 (FIG. 1), for example, or the service man can securely repair a failing spot in the image forming apparatus 1.

Figure 6:
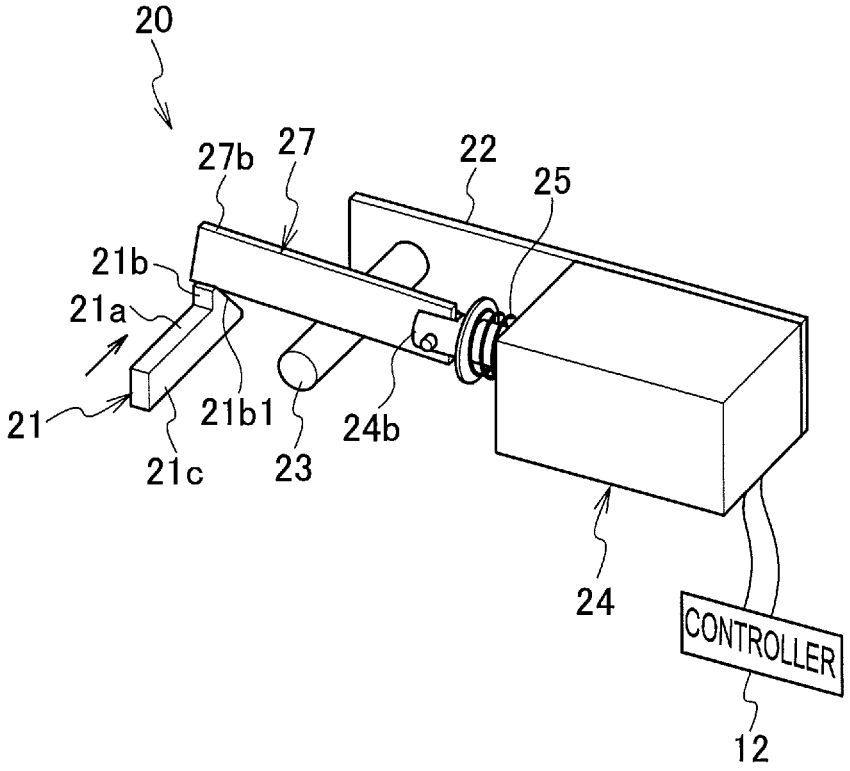
FIG. 6 is a perspective view illustrating a fifth operation state in which the open door is closed in the door opening/closing device according to the first embodiment of the present invention.

Subsequently, FIG. 6 illustrates a fifth operation state in which the open door 4 is closed in a perspective manner.

In this fifth operation state, the locking lever 27 has already moved to the left side by the return spring force of the compression spring 25 for return integrally with the movable iron core 24*b* of the solenoid 24 in the non-conduction state.

At this time, when the user or service man closes the door 4, the other end portion 27*b* side of the locking lever 27 is lifted up by an inclined surface 21*b*1 formed on a rear surface of the locking claw portion 21*b* of the locking hook 21. Then, after the other end portion 27*b* side of the locking lever 27 rides over the locking claw portion 21*b*, the locking lever 27 is locked by the locking hook 21. Therefore, the door 4 can be securely locked to the locking hook 21 and the locking lever 27 without conducting the solenoid 24 and returns to the locked state of the door 4 described above by using FIG. 2.

Summarizing the above, according to the door opening/closing device 20 of this embodiment, the locking hook 21 mounted on the inner surface of the door 4, the locking lever 27 swingably connected to the movable iron core 24*b* side of the solenoid 24 and having the free end on the opposite side of the connection portion, and the controller 12 for controlling the solenoid 24 are provided. The controller 12 subjects the solenoid 24 to non-conduction control when the door 4 is closed and locks the locking lever 27 to the locking hook 21 in conjunction with the movable iron core 24*b* advanced to the first position. Thus, the locked state of the door 4 is maintained. On the other hand, if the door 4 needs to be opened while the door 4 is in the locked state, the solenoid 24 is subjected to conduction control, and the locking lever 27 is separated away from the locking hook 21 in conjunction with the movable iron core 24*b* retreated to the second position so as to unlock the door. The control is executed such that, by subjecting the solenoid 24 to non-conduction control after unlocking, the free end of the locking lever 27 is brought into contact with the locking hook 21 by the return spring force of the compression spring 25 for return in conjunction with the movable iron core 24*b* advanced to the first position side, and the unlocked state is maintained while the door 4 is kept closed.

As a result, when the unlocked state is maintained while the door 4 is kept closed, the temperature rise of the solenoid 24 can be suppressed, and power to the door opening/closing device 20 can be saved. Moreover, if the door 4 needs to be opened, by maintaining the unlocked state while the door 4 is kept closed, the user or service man can open the door 4 at intended timing.

Moreover, according to the door opening/closing device 20 of this embodiment, the locking hook 21 is formed by extending to the inner side of the device housing 2 from the inner surface of the door 4 and includes the locking claw portion 21*b* at the tip end thereof. If this door 4 is opened when the solenoid 24 is in the non-conduction state and the door 4 has reached the unlock maintained state by the controller 12, the locking lever 27 leaves the side surface of the locking hook 21 moving integrally with the door 4, whereby the movable iron core 24*b* advances to the first position by the return spring force of the compression spring 25 for return. After that, by closing the door 4, the locking lever 27 advanced by the movable iron core 24*b* is lifted by the inclined surface 21*b*1 formed on the rear surface of the locking claw portion 21*b* of the locking hook 21 with the operation of closing the door 4, and after riding over the locking claw portion 21*b*, it is locked to the locking claw portion 21*b*. Thus, the door 4 can be securely locked by the locking hook 21 and the locking lever 27 without conducting the solenoid 24.

(Door Opening/Closing Device of Second Embodiment)

Subsequently, a door opening/closing device according to a second embodiment of the present invention will be described by using FIGS. 7 to 11.

Figure 7:
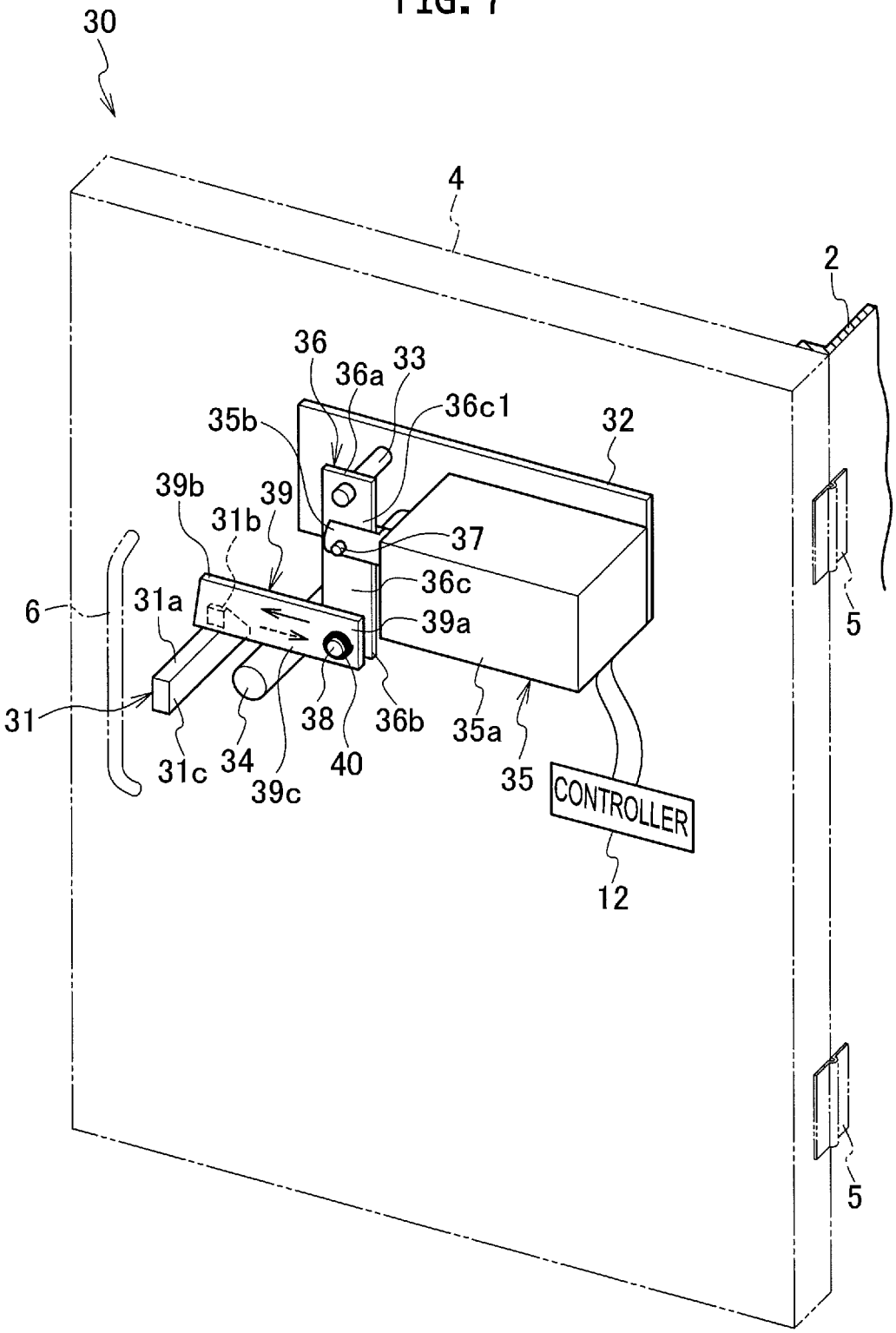
FIG. 7 is a view illustrating constitution of the door opening/closing device according to a second embodiment of the present invention and is a perspective view illustrating the first operation state in which the door is locked and closed.

FIG. 7 is a view illustrating constitution of the door opening/closing device according to the second embodiment of the present invention and schematically illustrates the first operation state in which the door is locked and closed. Moreover, FIGS. 8 to 11 schematically illustrate the second operation state to the fifth operation state from unlocking and opening the door and then, to closing the door again in the door opening/closing device according to the second embodiment of the present invention in the order of operations. In FIGS. 8 to 11, the door is not shown.

As illustrated in FIG. 7, in a door opening/closing device 30 according to the second embodiment of the present invention, too, the door 4 is provided on the device housing 2 of the image forming apparatus 1 (FIG. 1) so as to be opened and closed through the hinges 5 and 5 as described above.

Moreover, on the inner surface of the door 4 close to the handle 6 mounted on the outer side of the door 4, a locking hook 31 is integrally mounted. This locking hook 31 is formed by extending into the device housing 2 from the inner surface of the door 4 and includes a locking claw portion 31*b* described below at the tip end thereof.

That is, in the aforementioned locking hook 31, a locking base portion 31*a* having a rectangular shape substantially at a right angle to the inner surface of the door 4 and protruding substantially horizontally toward the depth in the device housing 2, a locking claw portion 31*b* protruding upward having a substantially triangular shape from the tip end portion on the depth of the locking base portion 31*a* which is a tip end on an opposite side of the inner surface of the door 4, and a side surface 31*c* of the locking base portion 31*a* having a predetermined height and facing the depth are integrally formed.

Moreover, on a bracket 32 which is a fixing member mounted substantially in parallel with the door 4 on the depth in the device housing 2, a cylindrical support shaft 33 on the locking hook 31 side and a cylindrical guide member 34 are mounted separately in the vertical direction toward the inner surface of the door 4 substantially in parallel with the locking hook 31.

At this time, the cylindrical guide member 34 includes a function of temporarily guiding a lower surface of a locking lever 39 which will be described later in the height direction, and a portion of this guide member 34 with which the lower surface of the locking lever 39 is brought into contact is disposed at a position lower than the locking base portion 31*a* of the locking hook 31.

Moreover, on the bracket 32, a solenoid 35 is mounted at an interval to the right side from the locking hook 31 and this solenoid 35 faces the inner surface of the door 4 and is fixed in a substantially horizontal attitude with its longitudinal direction in the right and left.

The aforementioned solenoid 35 accommodates an annular bobbin (not shown) around which a coil (not shown) is wound in a cuboid yoke 35*a*, and a lengthy movable iron core 35*b* formed having a cylindrical shape is accommodated in the bobbin linearly movably in the right-and-left direction as illustrated (arrow direction) capable of advancing/retreating.

At this time, the movable iron core 35*b* of the solenoid 35 is configured to linearly move between a first position advancing to the left side by a return spring force which will be described later in non-conduction and a second position retreating to the right side by an electromagnetic attracting force against a return spring force in conduction by ON/OFF control of an electric current to the coil through the controller 12 provided in the image forming apparatus 1 (FIG. 1).

Moreover, on the support shaft 33 mounted on an upper part of the bracket 32, a plate-shaped lever 36 is suspended downward substantially in parallel with the inner surface of the door 4 and supported swingably in the right-and-left direction.

On the aforementioned lever 36, a side surface 36*c* is formed having a lengthy plate shape between one end portion 36*a* on an upper part and the other end portion 36*b* on a lower part, and the movable iron core 35*b* of the solenoid 35 is connected to an intermediate portion 36*c*1 of the side surface 36*c* through a connecting pin 37.

In this second embodiment, since the movable iron core 35*b* of the solenoid 35 is connected to the lever 36, the movable iron core 35*b* can linearly move without rotation and does not come out from the inside of the solenoid 35.

Moreover, a shaft 38 is mounted on the other end portion 36*b* of the lever 36 toward the inner surface of the door 4, and since the plate-shaped locking lever 39 is swingably supported on this shaft 38 toward the locking hook 31 side, the lever 36 and the locking lever 39 cross each other substantially at a right angle.

At this time, when the lever 36 swings around the upper support shaft 33, with respect to a stroke of the movable iron core 35*b* of the solenoid 35 connected to the intermediate portion 36*c*1 of the side surface 36*c* of this lever 36 linearly moving between the first position and the second position, a moving amount of the locking lever 39 connected to the other end portion 36*b* side of the lever 36 can be enlarged to approximately twice, for example. Along with that, a width of the locking claw portion 31*b* of the locking hook 31 can be expanded from that of the first embodiment. Since the movable iron core 35*b* can smoothly move between the first position and the second position while a moving range of the movable iron core 35*b* of the solenoid 35 is regulated by the lever 36, an operation of the locking lever 39 connected to the other end portion 36*b* of the lever 36 is made reliable, and a stable mechanism in view of design can be obtained.

Moreover, a torsion spring 40 for return is fitted in the shaft 38, and one end of this torsion spring 40 for return is hooked by the lever 36, while the other end of the torsion spring 40 for return is hooked by the locking lever 39.

The torsion spring 40 for return urges an interval substantially orthogonal between the lever 36 and the locking lever 39 in a mutually expanding direction. Therefore, the movable iron core 35*b* of the solenoid 35 can be urged to the side of the first position through the lever 36, while the other end portion 39*b* side of the locking lever 39 can be pressed onto the locking base portion 31*a* of the locking hook 31.

In the aforementioned locking lever 39, a side surface 39*c* is formed having a rectangular plate shape between the one end portion 39*a* on the right side and the other end portion 39*b* on the left side, and an intermediate portion in the longitudinal direction crosses from above and rides across the guide member 34 mounted on the bracket 32.

The one end portion 39*a* side of the locking lever 39 is connected to the other end portion 36*b* side of the lever 36 through the shaft 38. Moreover, the other end portion 39*b* side of the locking lever 39 is located on an opposite side of the connection portion connected to the other end portion 36*b* side of the lever 36 through the shaft 38 and has a free end at the tip end portion and is made swingable in the vertical direction around the shaft 38. Then, in accordance with linear movement of the movable iron core 35*b* of the solenoid 35 between the first position and the second position, the other end portion 39*b* side is capable of getting close to/separating away from the locking base portion 31*a* and the locking claw portion 31*b* of the locking hook 31 mounted on the inner surface of the door 4.

When the door opening/closing device 30 according to the second embodiment of the present invention is configured as above, FIG. 7 illustrates the first operation state in which the door 4 is locked and closed in a perspective manner.

In this first operation state, when the door 4 is closed, the solenoid 35 is subjected to non-conduction control by the controller 12 and thus, the lever 36 swings in a clockwise direction around the support shaft 33 installed on the upper part of the bracket 32 by a return spring force of the torsion spring 40 for return.

Along with that, the movable iron core 35*b* of the solenoid 35 connected to the lever 36 through the connecting pin 37 reaches the first position advanced to the left side by the return spring force.

Moreover, the other end portion 39*b* side of the locking lever 39 connected to the other end portion 36*b* side of the lever 36 through the shaft 38 is mounted closer to the inner surface of the door 4 than the locking claw portion 31*b* on the locking base portion 31*a* of the locking hook 31 mounted on the inner surface of the door 4 by the own weight of the locking lever and the urging force of the torsion spring 40 for return.

As a result, when a user or service man grasps the handle 6 and tries to open the door 4 toward the front, the side surface 39*c* on the other end portion 39*b* side of the locking lever 39 mounted on the locking base portion 31*a* of the locking hook 31 is brought into contact with the locking claw portion 31*b* of the locking hook 31 and locked. Thus, the door 4 cannot be opened.

Therefore, in the second embodiment, the side surface 39*c* on the other end portion 39*b* side of the locking lever 39 functions as a locking portion, while the locking claw portion 31*b* of the locking hook 31 functions as a locked portion to be locked by the locking portion of the locking lever 39.

Figure 8:
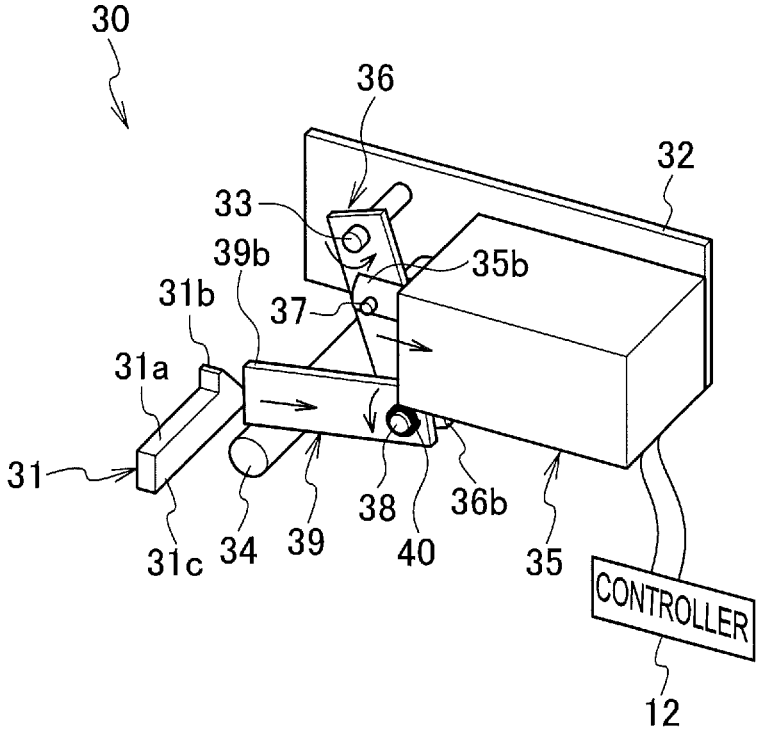
FIG. 8 is a perspective view illustrating the second operation state in which the solenoid is temporarily subjected to conduction control and the door is unlocked in the door opening/closing device according to the second embodiment of the present invention.

Subsequently, FIG. 8 illustrates the second operation state in which the door 4 is unlocked by subjecting the solenoid 35 to temporary conduction control in a perspective manner.

In this second operation state, when the door 4 is closed and locked, if the user or service man pushes a door-open button (not shown) mounted on the operation panel portion 3 of the image forming apparatus 1 (FIG. 1) or sheet jamming that occurred in the image forming apparatus 1 is automatically detected, the controller 12 subjects the solenoid 35 to temporary conduction control. At this time, the controller 12 executes the control such that those other than the solenoid 35 in the image forming apparatus 1 (FIG. 1) stop operations.

At this time, if the state in which the solenoid 24 is conducted continues, the solenoid 35 generates heat and badly affects the peripheral members or the electromagnetic attracting force of the movable iron core 35*b* weakens and thus, in this second embodiment, too, conduction to the solenoid 35 is performed temporarily only for a short time.

By means of this conduction control to the solenoid 35, the movable iron core 35*b* of the solenoid 35 retreats to the right side by the electromagnetic attracting force against the return spring force of the torsion spring 40 for return and reaches the second position.

At this time, the lever 36 connected to the movable iron core 35*b* of the solenoid 35 through the connecting pin 37 swings in a counterclockwise direction around the support shaft 33.

Along with that, the locking lever 39 connected to the other end portion 36*b* side of the lever 36 through the shaft 38 moves to the right side by a moving amount of approximately twice with respect to a stroke of linear movement of the movable iron core 35*b* of the solenoid 35 between the first position and the second position. Thus, the other end portion 39*b* side of this locking lever 39 separates away from the locking base portion 31*a* and the locking claw portion 31*b* of the locking hook 31 mounted on the inner surface of the door 4.

As a result, a slight gap is formed between the side surface 31*c* of the locking hook 31 and the tip end portion of the other end portion 39*b* of the locking lever 39, and the door 4 is unlocked.

Then, the locking lever 39 swings downward around the shaft 38 by its own weight and the urging force of the torsion spring 40 for return. After that, the other end portion 39*b* side of the locking lever 39 drops and the intermediate portion thereof in the longitudinal direction is brought into contact with the bracket 32 on the guide member 34 disposed at a position lower than the locking base portion 31*a* of the locking hook 31.

If the power supply, not shown, in the image forming apparatus 1 (FIG. 1) fails, temporary conduction to the solenoid 35 becomes impossible, and in this case, the service man can unlock the door 4 by lifting up the other end portion 39*b* side of the locking lever 39 upward around the shaft 38 by using a thin wire or the like through a gap of the door 4.

Figure 9:
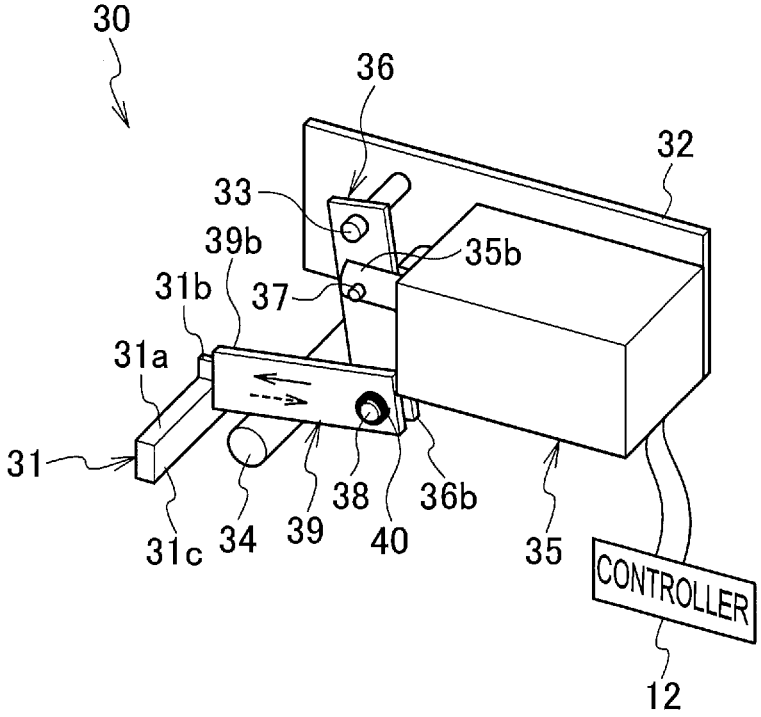
FIG. 9 is a perspective view illustrating the third operation state in which the temporary conduction to the solenoid is stopped in the state in which the door is unlocked in the door opening/closing device according to the second embodiment of the present invention.

Subsequently, FIG. 9 illustrates a third operation state in a perspective manner in which temporary conduction to the solenoid 35 is stopped in a state in which the door 4 is unlocked.

In this third operation state, when the door 4 is unlocked, the controller 12 stops the temporary conduction to the solenoid 35 and executes non-conduction control at appropriate timing after unlocking.

By means of this stop of the temporary conduction to the solenoid 35, the lever 36 swings in the clockwise direction around the support shaft 33 by the return spring force of the torsion spring 40 for return, and the movable iron core 35*b* of the solenoid 35 connected to this lever 36 through the connecting pin 37 tries to advance to the left side by the return spring force. At this time, the tip end portion (free end) of the other end portion 39*b* of the locking lever 39 connected to the other end portion 36*b* side of the lever 36 through the shaft 38 is brought into contact with the side surface 31*c* of the locking hook 31 mounted on the inner surface of the door 4 by the return spring force.

Therefore, in the second embodiment, the tip end portion of the other end portion 39*b* of the locking lever 39 functions as a touching portion, while the side surface 31*c* of the locking hook 31 functions as a touched portion to be touched by the touching portion of the locking lever 39.

Along with that, since the locking lever 39 is pushed back to the right side by the side surface 31*c* of the locking hook 31 while being guided by the guide member 34 mounted on the bracket 32, the movable iron core 35*b* of the solenoid 35 is also pushed back to the right side integrally with this locking lever 39 and thus, the state in which the door 4 is unlocked is maintained.

As a result, when the door 4 is unlocked, since the solenoid 35 is in the non-conduction state, a temperature rise of the solenoid 35 can be suppressed and at the same time, power for the door opening/closing device 30 can be saved.

Figure 10:
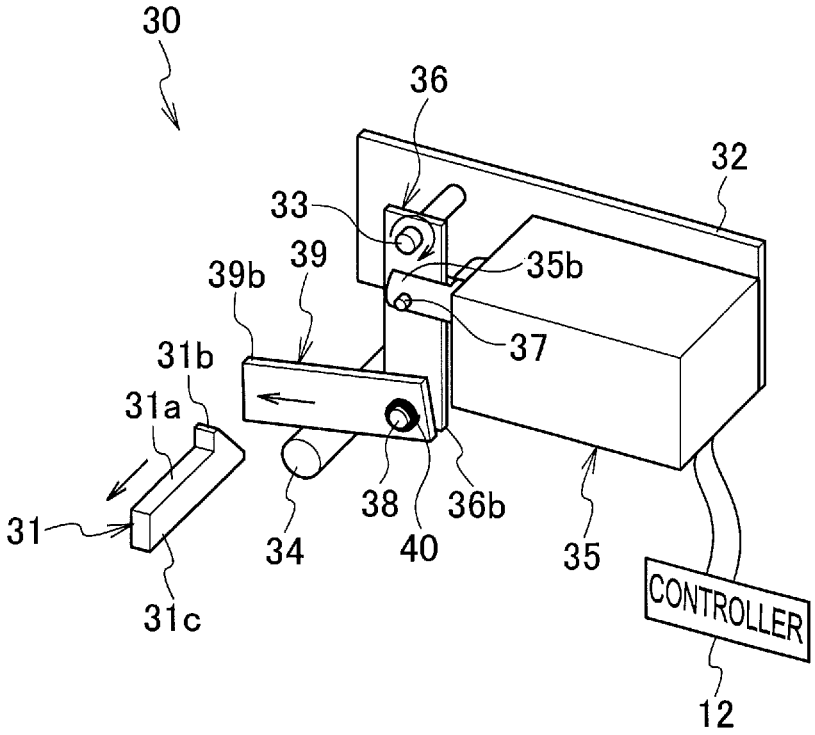
FIG. 10 is a perspective view illustrating the fourth operation state in which the door is unlocked and the door is opened in the state in which the solenoid is subjected to non-conduction control in the door opening/closing device according to the second embodiment of the present invention.

Subsequently, FIG. 10 illustrates the fourth operation state in a perspective manner in which the door 4 is unlocked and the door 4 is opened while the solenoid 35 is subjected to non-conduction control.

In this fourth operation state, the door 4 is unlocked by the controller 12 while the solenoid 35 is in the non-conduction state, and the door 4 reaches the unlock maintained state and thus, the user or service man can open the door 4 at intended timing.

Then, when the user or service man opens the door 4, the locking hook 31 also moves to an opening direction integrally with the door 4. Then, the tip end portion of the other end portion 39*b* of the locking lever 39 is separated away from the side surface 31*c* of the locking hook 31 during movement in the opening direction integrally with the door 4.

As a result, the urging force of the torsion spring 40 for return having been suppressed by the contact of the tip end portion of the other end portion 39*b* of the locking lever 39 with the side surface 31*c* of the locking hook 31 is released.

Along with that, the locking lever 39 is made movable to the left side by being guided by the guide member 34 mounted on the bracket 32. Thus, the lever 36 to which the locking lever 39 is connected swings in the clockwise direction around the support shaft 33, and the movable iron core 35*b* of the solenoid 35 connected to this lever 36 returns to the first position advanced to the left side by the return spring force.

Here, when the door 4 is opened, the user can securely remove the jamming sheet (not shown) occurring in the image forming apparatus 1 (FIG. 1), for example, or the service man can securely repair a failing spot in the image forming apparatus 1 and the like.

Figure 11:
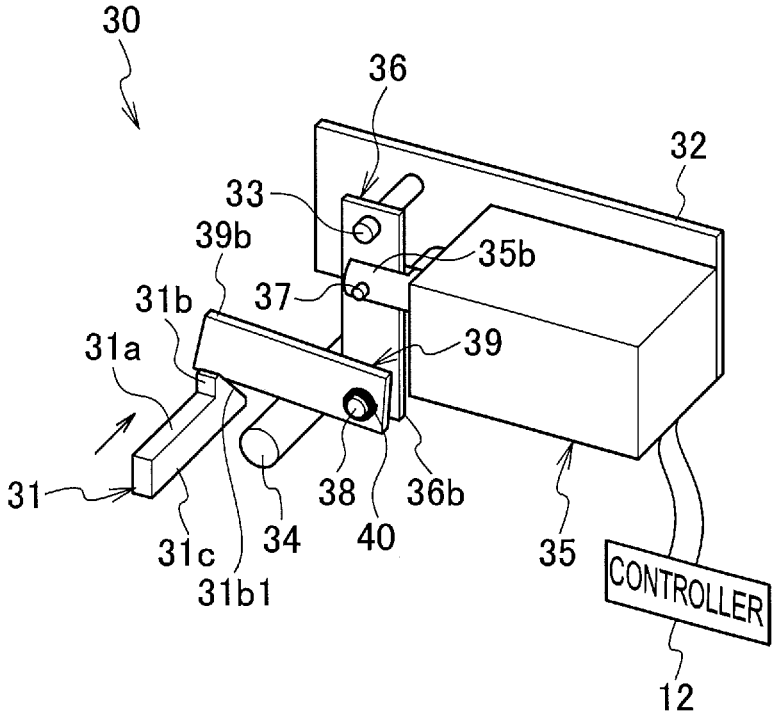
FIG. 11 is a perspective view illustrating the fifth operation state in which the open door is closed in the door opening/closing device according to the second embodiment of the present invention.

Subsequently, FIG. 11 illustrates a fifth operation state in which the open door 4 is closed in a perspective manner.

In this fifth operation state, the lever 36 to which the movable iron core 35*b* of the solenoid 35 in the non-conduction state is connected has already swung to the clockwise direction around the support shaft 33 by the return spring force of the torsion spring 40 for return, and along with that, the locking lever 39 connected to the other end portion 36*b* side of the lever 36 has also already moved to the left side by the return spring force of the torsion spring 40 for return.

At this time, when the user or service man closes the door 4, the other end portion 39*b* side of the locking lever 39 is lifted up by an inclined surface 31*b*1 formed on a rear surface of the locking claw portion 31*b* of the locking hook 31. Then, after the other end portion 39*b* side of the locking lever 39 rides over the locking claw portion 31*b*, the locking lever 39 is locked to the locking hook 31. Therefore, the door 4 can be securely locked by the locking hook 31 and the locking lever 39 without conducting the solenoid 35 and returns to the locked state of the door 4 described above by using FIG. 7.

Summarizing the above, according to the door opening/closing device 30 of this embodiment, the locking hook 31 mounted on the inner surface of the door 4, the locking lever 39 swingably connected to the movable iron core 35*b* side of the solenoid 35 and having the free end on the opposite side of the connection portion, and the controller 12 for controlling the solenoid 35 are provided. The controller 12 subjects the solenoid 35 to non-conduction control when the door 4 is closed and locks the locking lever 39 to the locking hook 31 in conjunction with the movable iron core 35*b* advanced to the first position. Thus, the locked state of the door 4 is maintained. On the other hand, if the door 4 needs to be opened while the door 4 is in the locked state, the solenoid 35 is subjected to conduction control, and the locking lever 39 is separated away from the locking hook 31 in conjunction with the movable iron core 35*b* retreated to the second position so as to unlock the door. The control is executed such that, by subjecting the solenoid 35 to non-conduction control after unlocking, the free end of the locking lever 39 is brought into contact with the locking hook 31 by the return spring force of the torsion spring 40 for return in conjunction with the movable iron core 35*b* advanced to the first position side, and the unlocked state is maintained while the door 4 is kept closed.

As a result, when the unlocked state is maintained while the door 4 is kept closed, the temperature rise of the solenoid 35 can be suppressed, and power to the door opening/closing device 30 can be saved. Moreover, if the door 4 needs to be opened, by maintaining the unlocked state while the door 4 is kept closed, the user or service man can open the door 4 at intended timing.

Moreover, according to the door opening/closing device 30 of this embodiment, the locking hook 31 is formed by extending to the inner side of the device housing 2 from the inner surface of the door 4 and includes the locking claw portion 31*b* at the tip end thereof. If this door 4 is opened when the solenoid 35 is in the non-conduction state and the door 4 has reached the unlock maintained state by the controller 12, the locking lever 39 leaves the side surface of the locking hook 31 moving integrally with the door 4, whereby the movable iron core 35*b* advances to the first position by the return spring force of the torsion spring 40 for return. After that, by closing the door 4, the locking lever 39 advanced by the movable iron core 35*b* is lifted by the inclined surface 31*b*1 formed on the rear surface of the locking claw portion 31*b* of the locking hook 31 with the operation of closing the door 4, and after riding over the locking claw portion 31*b*, it is locked to the locking claw portion 31*b*. Thus, the door 4 can be securely locked by the locking hook 31 and the locking lever 39 without conducting the solenoid 35.

Moreover, according to the door opening/closing device 30 of this embodiment, the locking lever 39 is swingably connected to the other end portion side of the lever 36 in which the movable iron core 35*b* of the solenoid 35 is connected to the intermediate portion between one end portion and the other end portion and having the one end portion pivotally supported swingably.

As a result, with respect to a stroke of the movable iron core 35*b* of the solenoid 35 linearly moving between the first position and the second position, the moving amount of the locking lever 39 can be enlarged, whereby a width of the locking hook 31 can be expanded. Moreover, since the movable iron core 35*b* can smoothly move between the first position and the second position while the moving range of the movable iron core of the solenoid 35 is regulated by the lever 36, the operation of the locking lever 39 connected to the other end portion of the lever 36 is made reliable, and the stable mechanism in view of design can be obtained.

The present invention is not limited to the aforementioned embodiments as they are but can be embodied by modifying the constituent elements within a range not departing from the gist thereof in a stage of practice. Moreover, by combining the plurality of constituent elements disclosed in the aforementioned embodiments as appropriate, various inventions can be formed. For example, some of the constituent elements may be deleted from all the constituent elements illustrated in the embodiments.

Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

The present application claims priority based on Japanese Patent Application No. 2015-010178 (filed on Jan. 22, 2015) and the entire content thereof is incorporated herein by reference.

According to the door opening/closing device of the present invention, when the locking hook mounted on the inner surface of the door, the locking lever swingably connected to the movable iron core side of the solenoid and having the free end on the opposite side of the connection portion, and the controller for controlling the solenoid are provided, the controller subjects the solenoid to non-conduction control when the door is closed so as to lock the locking lever to the locking hook in conjunction with the movable iron core advanced to the first position. On the other hand, control is executed such that, when the door is closed and locked, the solenoid is subjected to conduction control and the locking lever is separated away from the locking hook and unlocked in conjunction with the movable iron core retreated to the second position, and after the unlocking, the solenoid is subjected to non-conduction control and the free end of the locking lever is brought into contact with the locking hook by the return spring force in conjunction with the movable iron core advanced to the first position side and the unlocked state is maintained while the door is kept closed. As a result, when the unlocked state is maintained while the door is kept closed, the temperature rise of the solenoid can be suppressed, and power to the door opening/closing device can be saved. Moreover, by maintaining the unlocked state while the door is kept closed, the user or service man can open the door at intended timing.

What is claimed is:

1. A door opening/closing device comprising:

a door mounted on a device housing so as to be opened and closed;

a locking hook mounted on an inner surface of the door;

a solenoid mounted in the device housing and having a movable iron core advancing/retreating between a first position advanced by a return spring force during non-conduction of the solenoid and a second position retreated by an electromagnetic attracting force against the return spring force during conduction of the solenoid;

a locking lever connected swingably on a movable iron core side of the solenoid and having a free end on an opposite side of a connection portion, wherein the locking lever swings under its own weight such that the free end drops when the solenoid moves to the second position; and a controller for controlling the solenoid, wherein the locking hook is provided with a locking claw portion at which the free end of the locking lever can be hooked, when the movable iron core of the solenoid advances to the first position, the door is configured to be able to take either:

a locked state where the free end of the locking lever is located on a front face of the locking claw portion with respect to a moving direction of the locking hook such that the free end of the locking lever is hooked at the locking claw portion, or an unlocked state where a distal end of the free end of the locking lever abuts a side surface of the locking hook such that the free end of the locking lever is not hooked at the locking claw portion, when the door is closed and the need to open the door in the locked state arises, the controller changes the door into the unlocked state by:

executing conduction control of the solenoid, thereby retreating the movable iron core to the second position, separating the locking lever from the locking hook to release locking and causing the free end to drop, and thereafter executing non-conduction control of the solenoid after releasing locking, advancing the movable iron core to the first position, bringing the distal end of the free end of the locking lever to abut the side surface of the locking hook.

2. The door opening/closing device according to claim 1, wherein the locking claw portion is formed by extending to an inner side of the device housing from the inner surface of the door and the locking claw portion is provided at a tip end of the locking hook;

when the door in the unlocked state is opened:

the locking lever is separated from the side surface of the locking hook moving integrally with the door so that the movable iron core advances to the first position by the return spring force; and thereafter when the door is closed after the movable iron core advances to the first position:

the locking lever advanced by the movable iron core is lifted by an inclined surface formed on a back surface of the locking claw portion of the locking hook along with a closing operation of the door, and the locking lever is locked to the locking claw portion after the locking claw portion is overridden, such that the door is changed into the locked state.

3. The door opening/closing device according to claim 2, wherein the locking lever is swingably connected to a side of an end portion of a lever to which the movable iron core of the solenoid is connected at an intermediate portion of the lever, wherein the intermediate portion of the lever is between the end portion and a second end portion and the second end portion is pivotally supported.

4. The door opening/closing device according to claim 1, wherein the locking lever is swingably connected to a side of an end portion of a lever to which the movable iron core of the solenoid is connected at an intermediate portion of the lever, wherein the intermediate portion of the lever is between the end portion and a second end portion and the second end portion is pivotally supported.

5. The door opening/closing device according to claim 1, wherein:

the free end of the locking lever is a tip portion of the locking lever along a moving direction of the iron core that is induced by the solenoid or by the return spring force, and the locking lever can swing in a direction that is substantially perpendicular to the moving direction of the iron core.

6. The door opening/closing device according to claim 1, wherein in the locked state, an intermediate portion of the locking lever between the free end and the connection portion is in contact with an upper surface of the locking hook.

7. The door opening/closing device according to claim 1, further comprising a guide member configured to contact the locking lever when the locking lever swings under its own weight such that the free end drops.

8. An image forming apparatus comprising the door opening/closing device according to claim 1.

9. A door opening/closing device comprising:

a door mounted on a device housing so as to be opened and closed;

a locking hook mounted on an inner surface of the door;

a solenoid mounted in the device housing and swingably connected to a locking lever, wherein the locking lever is configured to advance toward a first position during non-conduction of the solenoid and is configured to retreat toward a second position during conduction of the solenoid, the locking lever has a free end, wherein the locking lever swings downwards under its own weight such that the free end drops when the locking lever is in the second position; and a controller for controlling the solenoid, wherein the locking hook is provided with a locking claw portion at which the free end of the locking lever can be hooked, when the locking lever advances to the first position, the door is configured to be able to take either:

a locked state where the free end of the locking lever is located on a front face of the locking claw portion with respect to a moving direction of the locking hook such that the free end of the locking lever is hooked at the locking claw portion, or an unlocked state where a distal end of the free end of the locking lever abuts a side surface of the locking hook such that the free end of the locking lever is not hooked at the locking claw portion, the controller changes the door into the unlocked state in which the free end of the locking lever is separated from the locking hook by executing conduction control of the solenoid, to retreat the locking lever into the second position, separating the locking lever from the locking hook to release locking and causing the free end to drop, and followed thereafter by executing non-conduction control of the solenoid after releasing locking, advancing the locking lever to the first position, bringing the distal end of the free end of the locking lever to abut the side surface of the locking hook.

* * * * *